US011006717B2

(12) United States Patent
Bentz et al.

(10) Patent No.: US 11,006,717 B2
(45) Date of Patent: May 18, 2021

(54) BENDABLE CRYSTAL STRAP

(71) Applicant: Bentz Luxury, Inc., San Jose, CA (US)

(72) Inventors: Melissa Bentz, San Jose, CA (US); Kimberly Jankowsky, San Jose, CA (US)

( * ) Notice: Subject to any disclaimer, the term of this patent is extended or adjusted under 35 U.S.C. 154(b) by 395 days.

(21) Appl. No.: 15/975,026

(22) Filed: May 9, 2018

(65) Prior Publication Data

US 2018/0325231 A1 Nov. 15, 2018

Related U.S. Application Data

(60) Provisional application No. 62/504,422, filed on May 10, 2017.

(51) Int. Cl.

| | |
|---|---|
| ***A45C 13/30*** | (2006.01) |
| ***A44C 5/00*** | (2006.01) |
| ***A45C 13/08*** | (2006.01) |
| ***A44C 15/00*** | (2006.01) |
| ***A44C 11/00*** | (2006.01) |
| ***A44C 5/02*** | (2006.01) |
| ***A45F 3/02*** | (2006.01) |
| ***A45C 3/06*** | (2006.01) |
| *A45C 1/02* | (2006.01) |

(52) U.S. Cl.

CPC ..... *A45C 13/30* (2013.01); *A44C 5/0053* (2013.01); *A44C 5/022* (2013.01); *A44C 11/002* (2013.01); *A44C 15/005* (2013.01); *A45C 3/06* (2013.01); *A45C 13/08* (2013.01); *A45F 3/02* (2013.01); *A45C 1/02* (2013.01)

(58) Field of Classification Search

CPC ..... A45C 13/30; A45C 13/08; A45C 3/06; A45C 11/02; A45C 1/02; A44C 1/002; A44C 5/0053; A44C 15/005; A44C 5/00; A44C 15/0025

USPC ..... 63/1.11, 33.1, 33.2; 150/103, 104, 107; 2/338

See application file for complete search history.

(56) References Cited

U.S. PATENT DOCUMENTS

| | | | | |
|---|---|---|---|---|
| 1,894,195 | A * | 1/1933 | Pulver | A44C 11/002 63/28 |
| 2,047,432 | A * | 7/1936 | Roedelheimer | A44B 11/28 24/265 R |
| 6,544,164 | B1 | 4/2003 | Fan | |
| 6,908,065 | B1 * | 6/2005 | Ritchie | A44C 11/002 140/92 |

(Continued)

FOREIGN PATENT DOCUMENTS

| | | | |
|---|---|---|---|
| CH | 704 881 | A1 | 10/2012 |
| DE | 90 16 213 | U1 | 4/1992 |

(Continued)

*Primary Examiner* — Sue A Weaver

(74) *Attorney, Agent, or Firm* — Louis Wu

(57) ABSTRACT

A flexible luxury strap is provided having a plurality of beads attached (or linked) to each other to form a substantially rectangular array of alternating first and second rows. The array has a length and a width. The first row has a number of substantially identical beads greater than the number of beads in the second row. The second row has a bead of an elongate shape whose length defines the width of the array. In some instances, the bead of an elongate shape may be formed by adhering a plurality of smaller beads together. Substantially all or all of the beads may be crystals.

19 Claims, 6 Drawing Sheets

(56) References Cited

U.S. PATENT DOCUMENTS

| | | | | |
|---|---|---|---|---|
| 2002/0108388 | A1* | 8/2002 | Wilson | B60P 3/20 62/323.3 |
| 2005/0034482 | A1* | 2/2005 | Imahashi | A44C 9/02 63/37 |
| 2011/0094009 | A1* | 4/2011 | Landry | A45C 13/08 2/144 |
| 2012/0067471 | A1* | 3/2012 | Swift | A45C 1/02 150/100 |

FOREIGN PATENT DOCUMENTS

| | | | | |
|---|---|---|---|---|
| DE | 202010014360 | U1 * | 3/2011 | |
| FR | 374 707 | A | 6/1907 | |
| FR | 745 178 | A | 5/1933 | |
| FR | 745178 | A * | 5/1933 | A44C 11/002 |

* cited by examiner

BENDABLE CRYSTAL STRAP

CROSS-REFERENCE TO RELATED APPLICATION

This application claims priority to U.S. Provisional Application Ser. No. 62/504,422, entitled "BENDABLE CRYSTAL STRAP," filed on May 10, 2017, by inventors Melissa Bentz and Kimberly Jankowsky, the disclosure of which is incorporated by reference in its entirety.

BACKGROUND

Field of the Invention

The invention relates generally to luxury items in the form of a bendable strap. More specifically, the invention relates to fabulous crystal straps that evoke a "got to have it" desire in human beings, e.g., male and female, young and old—particularly those with an enhanced, refined, and generally superior fashion sense.

Background Art

Human beings do not just like luxury items; they love luxury items. Not only do luxury items help provide a sense of great comfort and extravagant living to their owners, the items convey to others a sense of opulence, luxuriousness, sumptuousness, grandeur, and glamor. Luxury items are the objective antithesis of vulgarity.

For example, luxury items such as jewelry are considered desirable but are often expensive. People wish to have multiple pieces of jewelry to wear with different outfits and for different occasions. Typically, jewelry cannot be recast or modified. Importantly, the decorative portion of jewelry cannot be easily altered or substituted. For example, a beaded necklace with a diamond pendant may be beautiful, but not be very versatile.

Straps may take any of a number of forms and functions. In general, straps comprise or consist essentially of a long narrow strip of pliant material such as real or faux leather. Functionally, a strip may be equipped with a buckle or similar fastener for binding or securing objects.

When viewed in context, straps can contribute highly to whether a functional item is viewed as a luxury item. Factors associated with such perception include the materials used, the cost of the materials, the geometry of component parts, and the like. While not everyone will agree upon what represents luxury, economic market forces will generally determine what constitutes luxury.

With the above considerations in mind, there exist many opportunities to provide a useful, novel and nonobvious strap that conforms to wants of the luxury fashion market. The invention described herein represents a unique embodiment of such a strap.

SUMMARY OF THE INVENTION

In a first embodiment, a flexible luxury strap is provided having a plurality of beads attached (or linked) to each other to form a substantially rectangular array of alternating first and second rows. The array has a length and a width. The first row has a number of substantially identical beads greater than the number of beads in the second row. The second row has a bead of an elongate shape whose length defines the width of the array. In some instances, the bead of an elongate shape may be formed by adhering a plurality of smaller beads together, i.e., by using the same number of beads located in a first row. Substantially all or all of the beads may be crystals.

Compositionally, the beads may be compositionally identical. In such a case, the beads may include quartz, glass, or another ceramic material. Alternatively, the beads may be compositionally different. In such a case, at least some of the compositionally different beads may have substantially identical optical properties as seen by a human eye. For example, some beads may include quartz, glass, or other ceramic material, while other beads may include a lucite material.

The inventive strap may take any of a number of forms. For example, the strap may have a depth that is smaller than the width. The beads in the first row have a substantially square shape. The beads are typically strung together using monofilament line.

The inventive strap may be attached to a bag, provided in as a belt, and/or comprise at least 6 or 7 rows. A plurality of straps may be provided to form a luxury item, e.g., a purse having a retail value of at least $100 U.S. dollars. that also includes leather, e.g., from an animal selected from the hide of a mammal, reptile, or bird. Typically, the luxury item lacks vulgarity when perceived by an ordinary shopper.

Also provided are jewelry, comprising the inventive strap. Jewelry may take the form of a necklace or of a bracelet.

Other embodiments of the invention are described herein

DETAILED DESCRIPTION OF THE INVENTION

Before describing the present invention in detail, it is to be understood that the invention is not limited to specific luxury items, as such may vary. It is also to be understood that the terminology used herein is for the purpose of describing particular embodiments only, and is not intended to be limiting.

In addition, as used in this specification and the appended claims, the singular article forms "a," "an," and "the" include both singular and plural referents unless the context clearly dictates otherwise. Thus, for example, reference to "a bag" includes a plurality of bags as well as a single bag, reference to a "belt" includes a single belt as well as a combination of belts, and the like.

Furthermore, terminology indicative or suggestive of a particular spatial relationship between elements of the invention is to be construed in a relative sense rather an absolute sense unless the context of usage clearly dictates to the contrary. For example, the terms "over" and "on" as used to describe the spatial orientation of a strap relative to a bag does not necessarily indicate that the strap is located above the bag.

In this specification and in the claims that follow, reference will be made to a number of terms that shall be defined to have the following meanings, unless the context in which they are employed clearly indicates otherwise:

The term "bag" such as a "hand bag" is used herein in its ordinary sense and may refer to any container in which something can be carried. Exemplary bags include handbags, clutches purses, travel cases, duffle bags, backpacks, knapsacks, etc.

The term "crystal" is used to refer to a piece of a homogeneous solid substance having a geometrically regular form with symmetrically arranged plane faces. For example, highly transparent glass with a high refractive index may be used to form beads of crystals.

The term "substantially identical" as used to describe a plurality of items is used to indicate that the items are identical to a considerable degree, but that absolute identicalness is not required. For example, when beads are said to have "substantially identical optical properties," the beads may appear identical or sufficiently near identical such that any differences in their appearance are trivial in nature, e.g., as is the case for diamonds and cubic zirconia crystal. The terms "substantial" and "substantially" are used analogously in other contexts involve an analogous definition.

Figure 1:
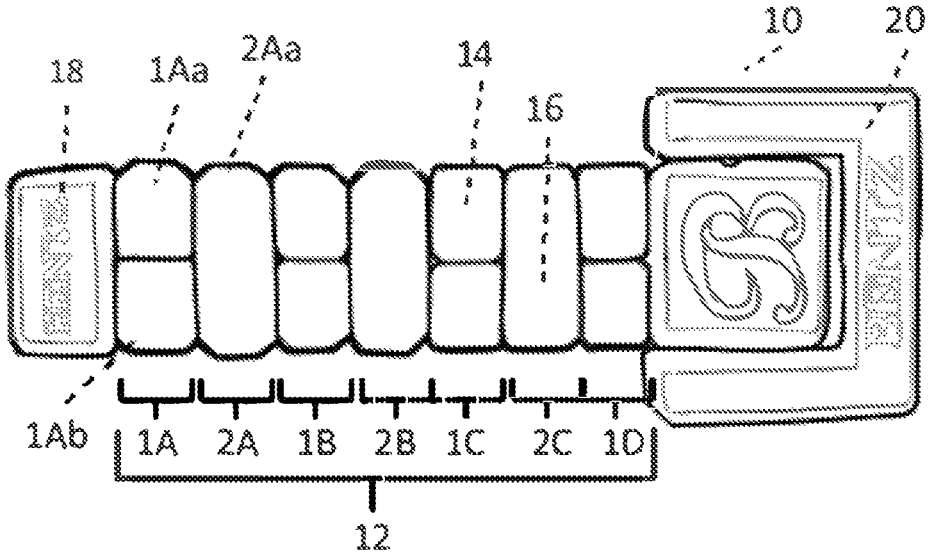
FIG. 1 is an annotated photograph that shows an exemplary strap of the invention.

FIG. 1 depicts an exemplary strap of the invention. As shown, a flexible luxury strap 10 is provided having a plurality of beads attached to each other to form a substantially rectangular array 12 of alternating first and second rows. The first rows indicated by 1A, 1B, 1C and 1D, and the second rows are indicated by 2A, 2B, and 2C, the first and second rows totaling seven rows in all. The array has a length spanning rows 1A, 2A, 1B, 2B, 1C, 2C, and 1D and a width. The first row has two substantially identical beads, 1Aa and 1Ab. The second row has a bead 2Aa of an elongate shape whose length defines the width of the array. Similarly, beads 1Aa and 1Ab also define the width of the array. The depth of the array is substantially smaller than the width.

Monofilaments 14 and 16 run through the beads along the length of the array from first hardware end piece 18 to second hardware end piece 20. As a result, the array shows flexibility along its length. In contrast, because the width of the array 12 is defined by elongate beads located at rows 2A 2B and 2C, the array 12 is not bendable along its width. In any case, the presence of elongate beads in the second rows serves an important mechanical purpose: to ensure that beads in the first rows remain generally aligned to each other so that the strap remains an integrated whole rather than a loose assembly of beads in strands.

Figure 2:
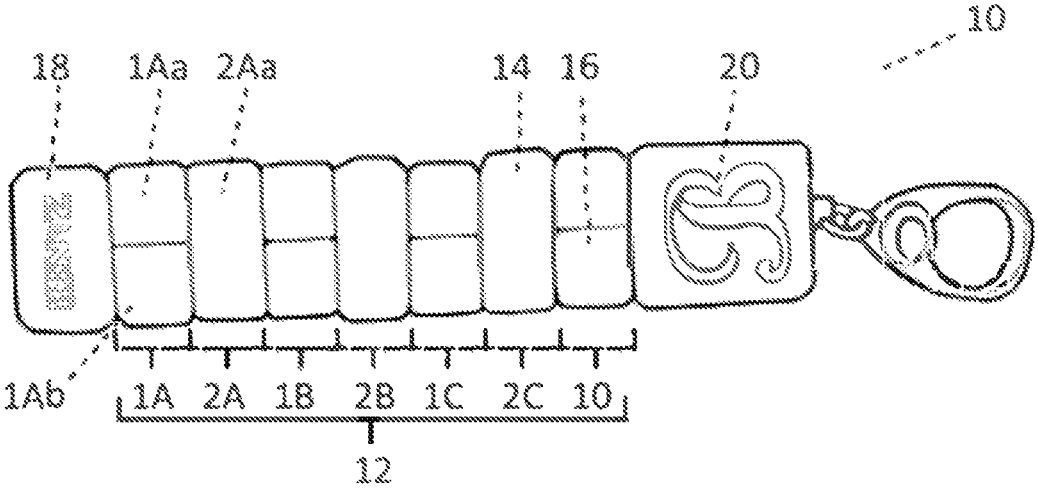
FIG. 2 is an annotated photograph that shows another exemplary strap of the invention.

FIG. 2 depicts another exemplary strap of the invention similar to that shown in FIG. 1. Like the strap 10 shown in FIG. 1, the strap 10 of FIG. 2 also includes a plurality of beads attached to each other to form a substantially rectangular array 12 of alternating first and second rows. In addition, monofilaments 14 and 16 also run through the beads along the length of the array from first end piece 18 to second end piece 20. However, the beads of the strap of FIG. 2 are smaller than the beads of the strap of FIG. 1. In addition, the second hardware end piece 20 of FIG. 2 is shaped and functions differently from the second hardware end piece of FIG. 1.

In any case, the array shows flexibility along its length. In contrast, because the width of the array 12 is defined by elongate beads located at rows 2A 2B and 2C, the array 12 is not bendable along its width.

Figure 3:
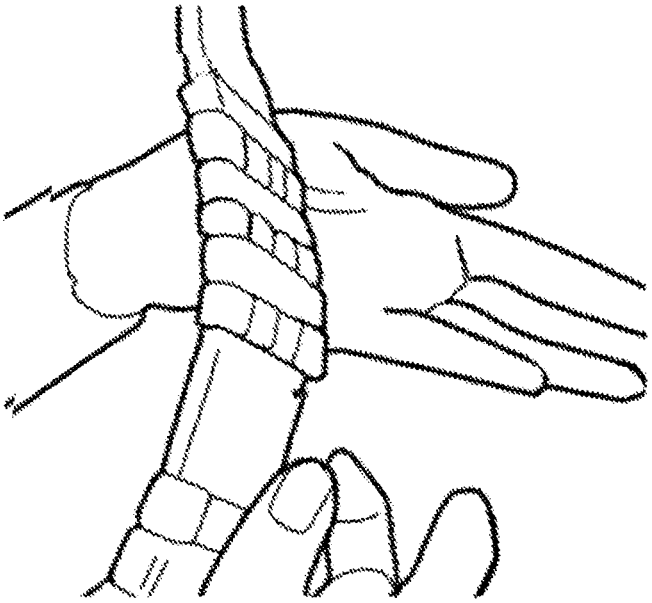
FIG. 3 is a photograph that shows still another exemplary strap of the invention as the strap is being assembled.

FIG. 3 is a photograph that shows still another exemplary strap of the invention as the strap is being assembled. A mid piece is shown in an open state, revealing portions of monofilaments that link together beads of the array. Located in the hand of the artisan assembling the strap are single barrel sleeves that fit over the monofilaments at appropriate locations so as to bring the beads together to form an array. Notably, the array formed include alternating first and second rows, wherein the first rows each include three identical beads and the second rows each include a single elongate bead. Accordingly, three monofilament strands instead of two are needed along the length of the array. In any case, first and second hardware end pieces are shown as well.

Figure 8:
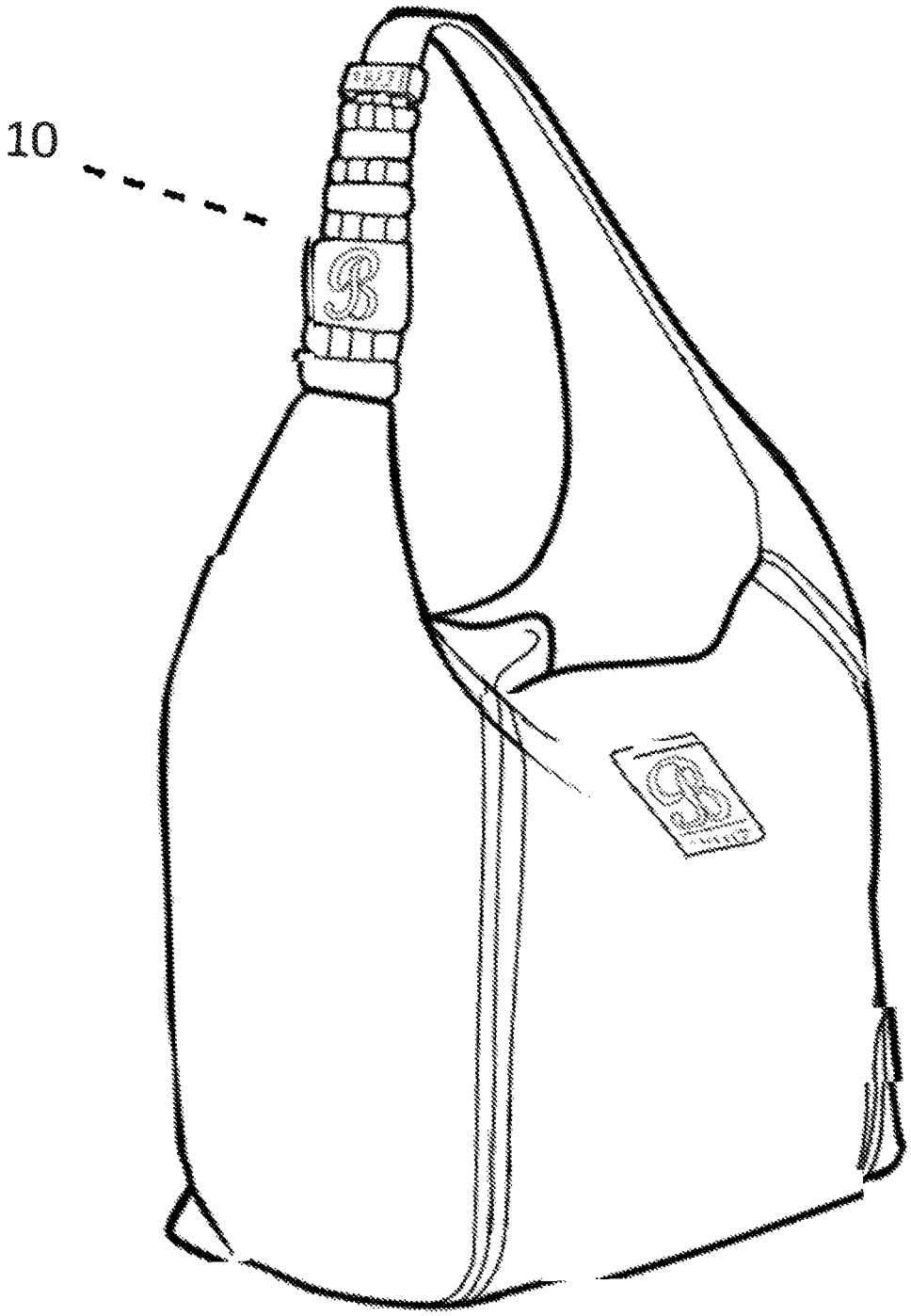
FIG. 8 shows a hobo bag of the invention that includes the strap being assembled in FIG. 3.
Figure 9:
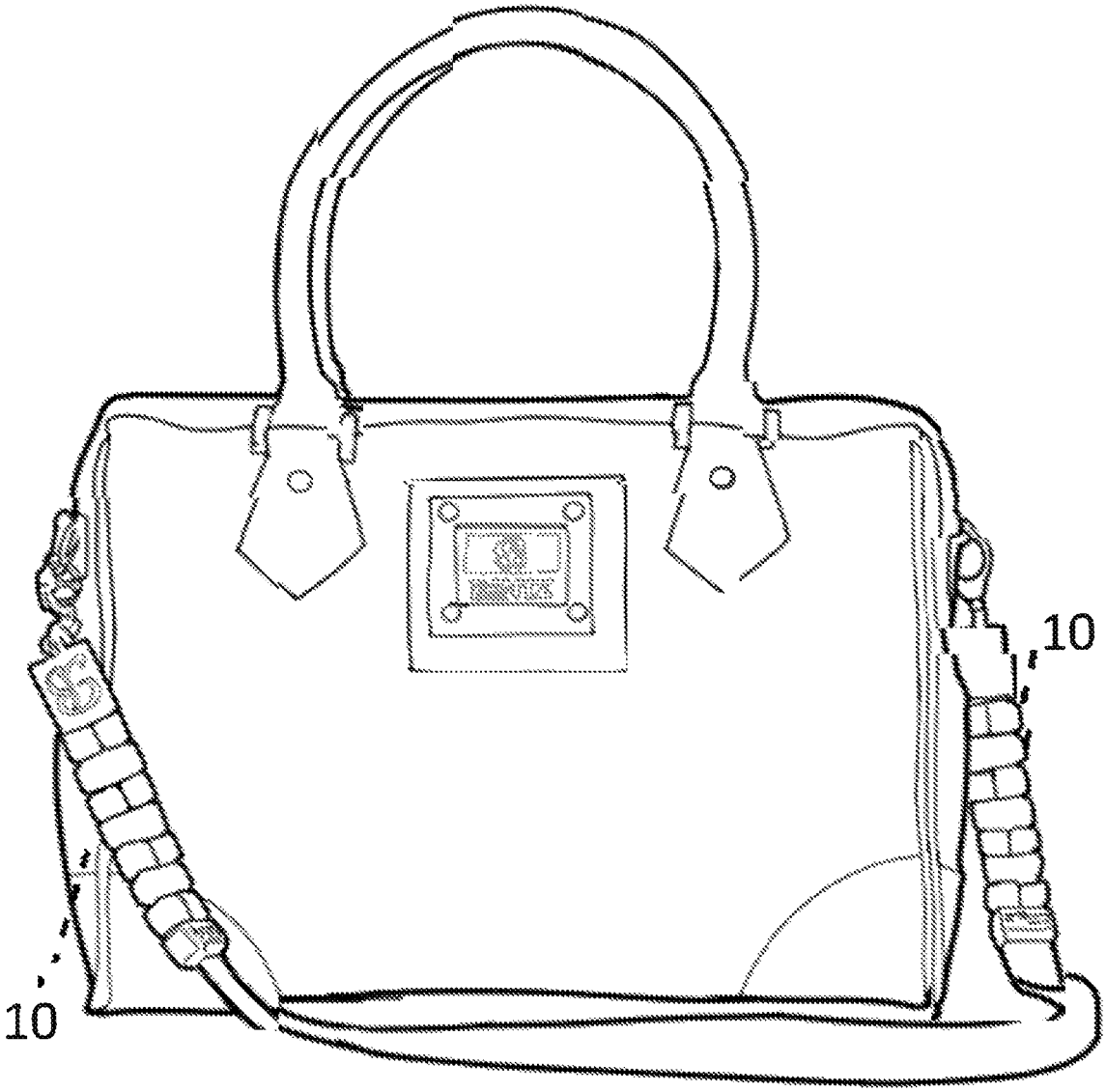
FIG. 9 shows a handbag of the invention that includes two straps shown in FIG. 2.

FIG. 8 shows a hobo bag of the invention that includes the strap being assembled in FIG. 3. FIG. 9 shows a handbag of the invention that includes two straps shown in FIG. 2. In either case, such bags can come in one or more colors, e.g., black, tan, brown, red, green, blue, etc. Black is uniquely fabulous because, in the context of the present invention, black goes with everything. This fact is nonobvious to those of ordinary skill in the art because the ordinary artisan would not understand the fabulosity and the high degree (and low depth) thereof relative to the luxury market. Similarly, tan and brown are also highly fabulous. In any case, such bags may also come in any of a number of finishes, e.g., gloss, semi-gloss, matte, etc. Hardware for such bags may be steel (stainless or otherwise), nickel, silver, brass, gold, combinations thereof, or alloys of the atomic elements of any of the foregoing.

Figure 10:
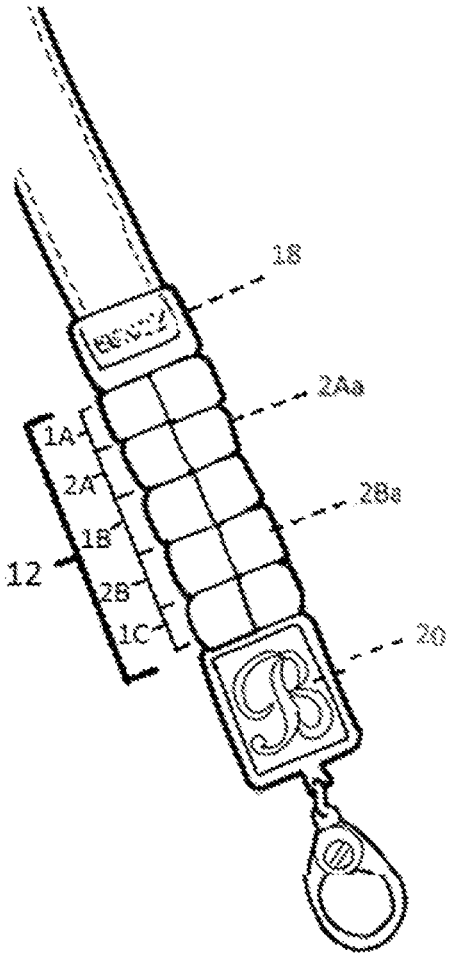
FIG. 10 is an annotated photograph that shows a further exemplary strap of the invention.

FIG. 10 depicts another exemplary strap of the invention. As shown, a flexible luxury strap 10 is provided having a plurality of beads attached to each other to form a substantially rectangular array 12 of alternating first and second rows. The first rows are indicated by 1A, 1B and 1C, and the second rows are indicated by 2A and 2B, the first and second rows totaling five rows in all. The array has a length spanning rows 1A, 2A, 1B, 2B, and 1C and a width. The array is strung together from first hardware end piece 18 to second hardware end piece 20

Figure 11:
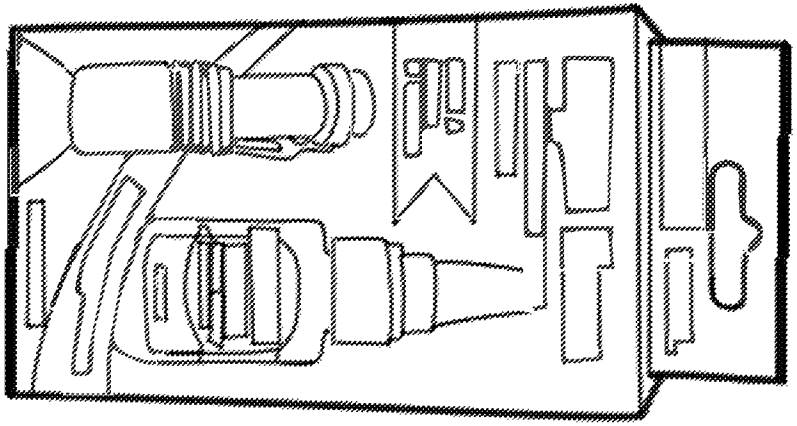
FIG. 11 shows a package of an adhesive that may be used in connection with the invention.

The first row has two substantially identical beads. Unlike the straps shown in FIGS. 1 and 2, each second row has a bead that is formed by adhering two beads of the size shown, e.g., in row 1A, together. As a result, beads 2Aa and 2Ba have an elongate shape whose length defines the width of the array. As shown in FIG. 11, a cyanoacrylate adhesive may be used to form the beads of the second rows 2A and 2B. Thus, all beads in this embodiment are of substantially identical composition.

The following are some specifications associated with exemplary bags of the invention. While such specifications may vary somewhat, numerical values associated with these specifications may represent inventive elements of the subject matter described herein.

Figure 4:
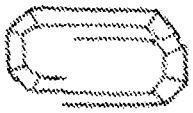
FIG. 4 is a photograph of an exemplary elongate bead that may define the width of a strap of the invention.
Figure 5:
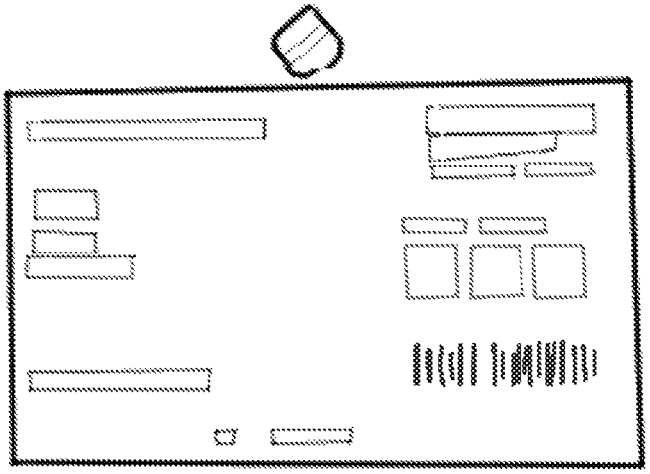
FIG. 5 depicts an envelope that contains a bead that may be used in a first row of the array of the strap of the invention as well as the bead itself.

FIG. 4 is a photograph of an elongate lucite bead that may be used to define the width of a crystal array described herein. As shown, two through holes are provided to allow a monofilament to be strung therethrough. Thus, the bead shown in FIG. 4 may be used to form the array that includes alternating first and second rows, wherein the first rows each have two substantially identical beads, and the second rows each have a single bead as shown in FIG. 4 whose length defines the width of the array. For example, elongate lucite beads have been custom made with two holes 30 and 60 degree angles. They may have a length of 1 inch, a width of 0.470 inch and a depth of 0.470 inch FIG. 5 depicts an envelope that contains a bead that may be used in a first row of the array of the strap of the invention as well as the bead itself. As shown, a crystal beads of the invention may be obtained from Swarovski as item #5601 Square bead, size 12 mm, color Crystal, having a through hole.

Figure 6:
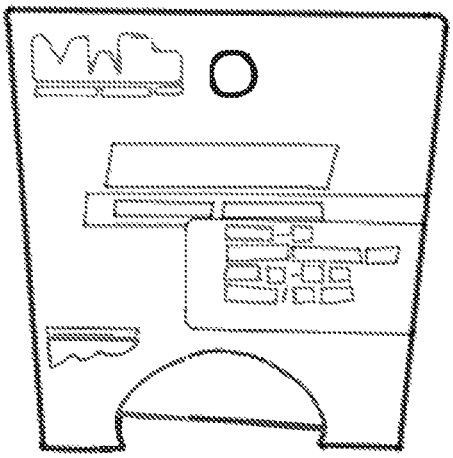
FIG. 6 depicts a package of sleeves that may be used in the strap of the invention

FIG. 6 depicts a package of sleeves that may be used in the strap of the invention. The sleeves (crimps) are of Malin Brand, are single barreled, and have a strength of 60 lb. The sleeve number and size is M5S 0.071.

Figure 7:
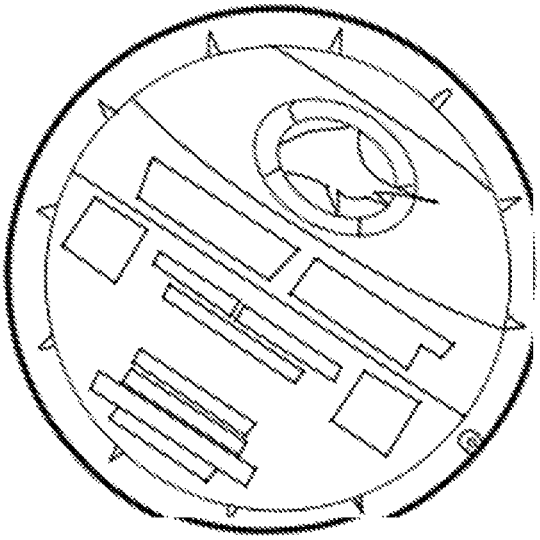
FIG. 7 depicts a package of monofilament that may be used in the strap of the invention

FIG. 7 depicts a package of monofilament that may be used in the strap of the invention. Depicted is Brand Offshore Angler, model #659-590C, a premium saltwater monofilament. The clear monofilament has a diameter of 1 mm and passes a 100 lb. test at a test length of twenty-five inches.

Variations of the present invention will be apparent to those of ordinary skill in the art in view of the disclosure contained herein. For example, the inventive strap may be constructed to contain or exclude specific features according to the intended use of the invention.

It is to be understood that, while the invention has been described in conjunction with the preferred specific embodiments thereof, the foregoing description merely illustrates and does not limit the scope of the invention. Numerous alternatives and equivalents exist which do not depart from the invention set forth above. For example, any particular embodiment of the invention, e.g., those depicted in any drawing herein, may be modified to include or exclude features of other embodiments. Wearable items of apparel such as belts, purses, backpacks, suitcases, and the like are too envisioned by the inventors. Other aspects, advantages, and modifications within the scope of the invention will be apparent to those skilled in the art to which the invention pertains.

We claim:

1. A flexible luxury strap physically associated via end piece hardware with a leather and/or metal item selected from a bag, purse, and jewelry, the strap comprising:

a plurality of beads attached to each other to form a substantially rectangular array of alternating first and second rows terminating in at least one end piece hardware, wherein the array has a length and a width, the first row has a number of substantially identical beads greater than the number of beads in the second row, the second row has a bead of an elongate shape whose length defines the width of the array, substantially all or all of the beads are crystals; and the at least one end piece hardware exhibits the array's width.

2. The strap of claim 1, wherein the beads are compositionally substantially identical.

3. The strap of claim 1, wherein at least some beads include quartz, glass, or other ceramic material.

4. The strap of claim 1, wherein the strap has a depth that is smaller than the width.

5. The strap of claim 1, being flexible along the length of the array.

6. The strap of claim 1, wherein the bead of the second row is formed by adhering a plurality of smaller beads together.

7. The strap of claim 1, wherein the beads in the first row have a substantially square shape.

8. The strap of claim 1, wherein the beads are strung together using monofilament line along the length.

9. The strap of claim 1, wherein the first rows or second rows are each formed from two beads.

10. The strap of claim 1, wherein the first rows each comprise three beads.

11. The strap of claim 1, attached to a bag via the at least one end piece hardware.

12. The strap of claim 1, in the form of a belt.

13. The strap of claim 1, comprising at least 6 rows along the length.

14. The strap of claim 1, forming a luxury leather item that includes an additional strap of crystal beads.

15. The straps of claim 14, wherein the leather item is formed from an animal hide selected from a mammal, reptile, and/or bird hide.

16. The straps of claim 14, wherein the luxury item is a purse.

17. The strap of claim 14, wherein all beads are substantially compositionally identical.

18. The strap of claim 1, wherein the beads are glass crystals.

19. A luxury strap physically associated via at least one endpiece hardware with a leather and/or metal item selected from a bag, purse, and jewelry, the strap comprising:

a plurality of beads attached to each other to form an array of alternating first and second rows terminating in the at least one end piece hardware, wherein the array has a length and a width, the first row has one or two substantially identical beads, the second row has a bead of an elongate shape whose length defines the width of the array, substantially all or all of the beads are crystals, the end piece hardware exhibits the array's width, the strap is bendable along the array's length.

* * * * *